US006972139B1

(12) United States Patent
Teegarden et al.

(10) Patent No.: US 6,972,139 B1
(45) Date of Patent: Dec. 6, 2005

(54) THERMAL DONOR

(75) Inventors: David M. Teegarden, Pittsford, NY (US); Christine J. Landry-Coltrain, Fairport, NY (US); Walter H. Isaac, Penfield, NY (US); Dennis J. Massa, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/017,377

(22) Filed: Dec. 20, 2004

(51) Int. Cl.[7] ..... B41M 5/035; B41M 5/38; G03C 7/02; G03C 1/73

(52) U.S. Cl. ..... 428/32.85; 428/32.87; 428/500; 428/522; 430/200; 430/201; 430/270.1; 430/338; 430/964; 503/227

(58) Field of Search ..... 430/200, 201, 430/270.1, 338, 964; 428/32.85, 32.87; 503/227

(56) References Cited

U.S. PATENT DOCUMENTS

| | | | | |
|---|---|---|---|---|
| 4,650,494 A | * | 3/1987 | Kutsukake et al. | 8/471 |
| 4,985,395 A | | 1/1991 | Vanmaele et al. | |
| 5,026,677 A | | 6/1991 | Vanmaele | |
| 5,068,282 A | * | 11/1991 | Kanto et al. | 525/61 |
| 5,082,823 A | | 1/1992 | Vanmaele et al. | |
| 5,294,588 A | | 3/1994 | Mori et al. | |
| 5,308,736 A | | 5/1994 | Defieuw et al. | |
| 5,332,713 A | * | 7/1994 | Oldfield et al. | 503/227 |
| 5,378,676 A | | 1/1995 | Defieuw et al. | |
| 5,474,970 A | | 12/1995 | Defieuw et al. | |

FOREIGN PATENT DOCUMENTS

| | | |
|---|---|---|
| JP | 4022685 | 1/1992 |
| JP | 4045993 | 2/1992 |
| JP | 04147893 A | 5/1992 |
| JP | 06048053 A | 2/1994 |
| JP | 06316171 A | 11/1994 |

OTHER PUBLICATIONS

Landry-Coltrain et al., "Thermal Donor For High Speed Printing", filed Dec. 20, 2004 as U.S. Appl. No. 11/017,487.
Isaac et al., "Thermal Donor For High Speed Printing", filed Dec. 20, 2004 as U.S. Appl. No. 11/017,070.
Massa et al., "Thermal Print Assembly", filed Dec. 20, 2004 as U.S. Appl. No. 11/017,590.

* cited by examiner

*Primary Examiner*—Richard L. Schilling
(74) *Attorney, Agent, or Firm*—Kathleen Neuner Munne

(57) ABSTRACT

A dye-donor element, a method of printing using the dye-donor element, and a print assembly including the dye-donor element are described, wherein the dye-donor layer of the dye-donor element includes a polyvinylacetal copolymer as a binder.

21 Claims, No Drawings

THERMAL DONOR

CROSS REFERENCE TO RELATED APPLICATIONS

Cross-reference is made to related co-filed applications, U.S. applications Ser. No. 11/017,070 to Isaac et al., Ser. No. 11/017,590 to Massa et al., and Ser. No. 11/017,487 to Landry-Coltrain et al.

FIELD OF THE INVENTION

A thermal dye-donor element having a polyvinylacetal copolymer binder is described.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce cyan, magenta, and yellow electrical signals. These signals can be transmitted to a thermal printer. To obtain a print, a black, cyan, magenta, or yellow dye-donor layer, for example, can be placed face-to-face with a dye image-receiving layer of a receiver element to form a print assembly, which can be inserted between a thermal print head and a platen roller. A thermal print head can be used to apply heat from the back of the dye-donor sheet. The thermal print head can be heated up sequentially in response to the black, cyan, magenta, or yellow signals. The process can be repeated as needed to print all colors, and a laminate or protective layer, as desired. A color hard copy corresponding to the original picture can be obtained. Further details of this process and an apparatus for carrying it out are contained in U.S. Pat. No. 4,621,271 to Brownstein.

Thermal transfer works by transmitting heat through the donor from the backside to the dye-donor layer. When the dyes in the dye-donor layer are heated sufficiently, they sublime or diffuse, transferring to the adjacent dye-receiving layer of the receiver element. The density of the dye forming the image on the receiver can be affected by the amount of dye transferred, which in turn is affected by the amount of dye in the dye layer, the heat the dye layer attains, and the length of time for which the heat is maintained at any given spot on the donor layer.

At high printing speeds, considered to be 2.0 msec/line or less, the print head undergoes heat on/off cycles very rapidly. This generated heat must be driven through the dye donor support assemblage very rapidly to effect the dye transfer from the donor to the receiver. Each layer in the donor can act as an insulator, slowing down the heat transfer through the layers of the donor to the receiver. Because of the short heat application time, any reduction in heat transfer efficiency results in a lower effective temperature in the donor layer during printing, which can result in a lower transferred dye density. It is known to overcome the low print density associated with shorter line times by increasing the print-head voltage, increasing the dye density in the dye donor layer, or a combination thereof. Applying higher print head voltages can decrease the lifetime of the thermal print head, and requires a higher power supply, both of which increase cost. Increasing the dye density in the dye-donor layer increases costs, as well as increasing the chance of unwanted dye transfer, such as during storage of a dye-donor element.

Another problem exists with many of the dye-donor elements and receiver elements used in thermal dye transfer systems. At the high temperatures used for thermal dye transfer, many polymers used in these elements can soften and adhere to each other, resulting in sticking and tearing of the donor and receiver elements upon separation from one another after printing. Areas of the dye-donor layer other than the transferred dye can adhere to the dye image-receiving layer, causing print defects ranging from microscopic spots to sticking of the entire dye-donor layer on the receiver. This is aggravated when higher printing voltages, resulting in higher temperatures, are used in high-speed printing. Another problem with high-speed printing is that the more rapid physical motion of the donor/receiver assembly results in higher peel rates between the donor element and the receiver element as they are separated after printing, which can aggravate sticking of the donor and receiver.

U.S. Pat. No. 5,294,588 discloses a binder for a dye-donor layer containing a polyvinylacetal resin composed of 80% or more vinylacetal groups, 15–20% vinyl alcohol groups, and less than 2% vinyl acetate groups for increased shelf life of the dye-donor element. The polyvinylacetal resin disclosed has a high glass transition temperature (Tg) and high degree of polymerization.

There is a need in the art for reducing or eliminating donor-receiver sticking and increasing print speed.

SUMMARY OF THE INVENTION

A thermal dye donor element, a print assembly including the element, and a method of printing are described, wherein the dye donor element includes a support and a dye layer, wherein the dye layer comprises a dye and a binder of the following formula:

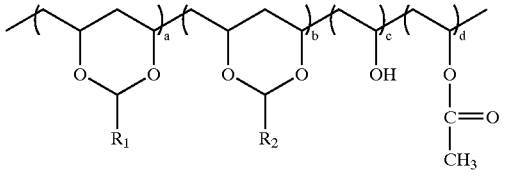

wherein each $R_1$ is an alkyl group of from 0 to 5 carbon atoms, wherein each alkyl group independently can be linear, branched, or cyclic; each $R_2$ is a linear, branched, or cyclic alkyl group of from 4 to 25 carbon atoms, or an aryl group of from 4 to 25 carbon atoms, wherein the aryl group is not unsubstituted phenyl;

a represents a mole % of from 0 to 98;

b represents a mole % of from 1 to 98;

c represents a mole % of from 0 to 12;

d represents a mole % of from 0 to 2; and the sum of a, b, c, and d equals 100, and the copolymer having a glass transition temperature (Tg) of from 40° C. to 55° C.

Advantages

A dye-donor element and method of printing using the same are provided, wherein the dye-donor element reduces or eliminates donor-receiver sticking, and can be used for fast printing.

DETAILED DESCRIPTION OF THE INVENTION

A dye-donor element having a polyvinylacetal copolymer binder, a printing assembly including the dye-donor element and a receiver element, and a method of printing using the dye-donor element are disclosed.

As used herein, "sticking" refers to adherence of a dye-donor element to a receiver element. Sticking can be detected by resultant defects in the dye-donor element or receiver element. For example, sticking can cause a removal of dye from the dye-donor element, appearing as a clear spot on the dye-donor element, or an over-abundance of dye on the receiver element. Sticking also can cause an uneven or spotty appearance on the dye-donor element. "Gross sticking" is when the dye-donor layer of the dye-donor element is pulled off of a support layer and sticks to the receiver element. This can appear as uneven and randomized spots across the dye-donor element and receiver element. "Microsticking" results in an undesirable image where a small area of the dye-donor element and receiver element stick together. Microsticking can be observed with a magnifying glass or microscope.

"Defect-free" or "defect-free image" as used herein refers to a printed image having no indication of donor-receiver sticking as defined herein, and having no areas of dye-dropout in the image, wherein dye-dropout is defined as the absence of transfer of dye to the receiver element, or insufficient transfer of the dye to the receiver element, on a pixel by pixel basis.

The dye-donor element can include a dye-donor layer. The dye-donor layer can include one or more colored areas (patches) containing dyes suitable for thermal printing. As used herein, a "dye" can be one or more dye, pigment, colorant, or a combination thereof, and can optionally be in a binder or carrier as known to practitioners in the art. During thermal printing, at least a portion of one or more colored areas can be imagewise or patch transferred to the receiver element, forming a colored image on the receiver element. The dye-donor layer can include a laminate area (patch) having no dye. The laminate area can follow one or more colored areas. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a full color image with a protective laminate layer on a receiver element.

Any dye transferable by heat can be used in the dye-donor layer of the dye-donor element. The dye can be selected by taking into consideration hue, lightfastness, and solubility of the dye in the dye donor layer binder and the dye image receiving layer binder. Examples of suitable dyes can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 26, 36, 56, and 31;

C.I. Disperse Yellow 56, 14, 16, 29, 201 and 231;

C.I. Solvent Blue 70, 35, 63, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3;

C.I. Solvent Yellow 93; and

C.I. Solvent Green 3.

Further examples of sublimable or diffusible dyes that can be used include anthraquinone dyes, such as Sumikalon Violet RS® (product of Sumitomo Chemical Co., Ltd.), Dianix Fast Violet 3R-FS® (product of Mitsubishi Chemical Corporation), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5 GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.); magenta dyes of the structures

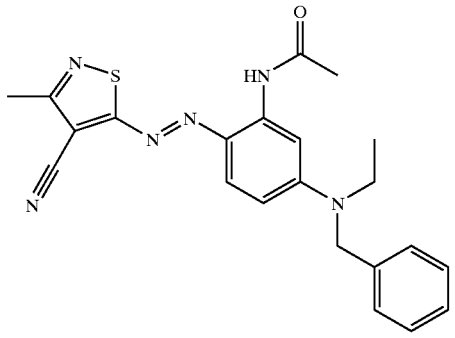

, and

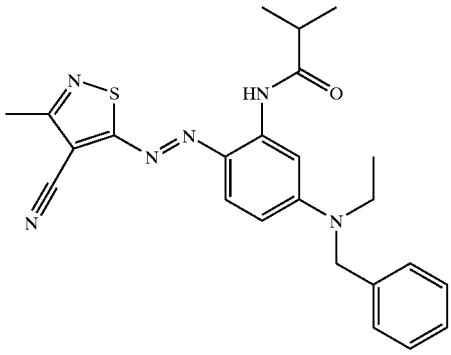

,

-continued

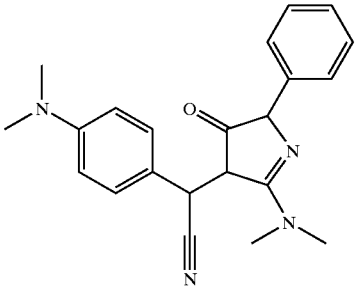

;

cyan dyes of the structures

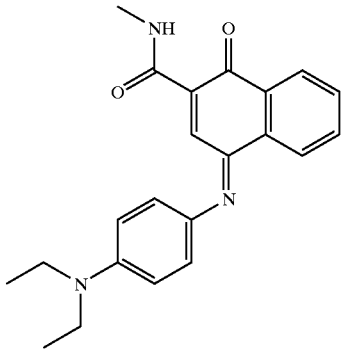

,

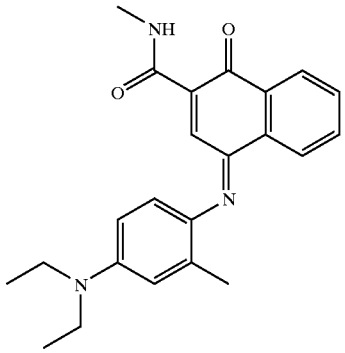

,

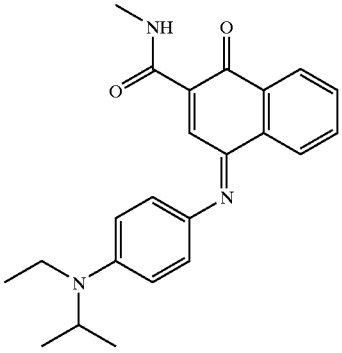

, and

-continued

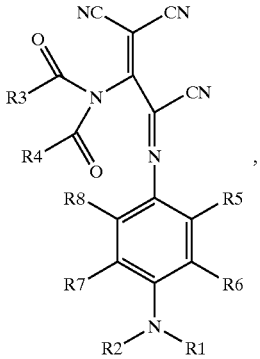

, where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and/or R7 and R8 together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group; and yellow dyes of the structures

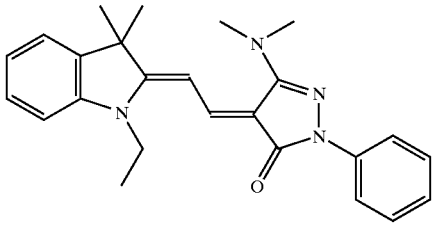

, and

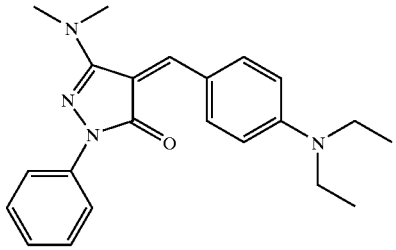

,

Further examples of useful dyes can be found in U.S. Pat. Nos. 4,541,830; 5,026,677; 5,101,035; 5,142,089; 5,804,531; and 6,265,345, and U.S. Patent Application Publication No. U.S. 20030181331. Suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K.K.), and Waxoline AP-FW (Solvent Blue 36, manufactured by ICI). Suitable magenta dyes can include MS Red G (Disperse Red 60, manufactured by Mitsui Toatsu Chemicals, Inc.), and Macrolex Violet R (Disperse Violet 26, manufactured by Bayer). Suitable yellow dyes can include Phorone Brilliant Yellow S-6 GL (Disperse Yellow 231, manufactured by Sandoz K.K.) and Macrolex Yellow 6G (Disperse Yellow 201, manufactured by Bayer). The dyes can be employed singly or in combination to obtain a monochrome dye-donor layer or a black dye-donor layer. The dyes can be used in an amount of from 0.05 g/m$^2$ to 1 g/m$^2$ of coverage. According to various embodiments, the dyes can be hydrophobic.

Each dye-donor layer patch can range from 20 wt. % to 90 wt. % dye, relative to the total dry weight of all components in the layer. A high amount of dye is desirable for increased efficiency, but higher amounts of dye can lead to increased occurrences of donor/receiver sticking. Depending on the efficiency of the dye-donor layer, a lower amount of dye can be used to achieve the same efficiency as a different dye-donor layer. The dye percent is ideally chosen in view of the specific donor and receiver combination. Varying the amount of dye in the donor can aid in matching the efficiency between different dye patches, for example, a cyan, magenta, and yellow patch. For example, yellow and/or magenta patch dye amounts can be between 20 wt. % and 75 wt. % dye relative to the total dry weight of all components in the layer, for example, between 30 wt. % and 50 wt. %. A cyan patch dye amount can be between 40 wt. % and 90 wt. % dye relative to the total dry weight of all components in the layer, for example, between 55 wt. % and 75 wt. %.

To form a dye-donor layer, one or more dyes can be dispersed in a polymeric binder such as a polyvinylacetal copolymer. Mixtures of various polyvinylacetal copolymers can be used. The binder can be used in an amount of from 0.05 g/m$^2$ to 5 g/m$^2$.

A suitable polyvinylacetal copolymer binder can have formula I:

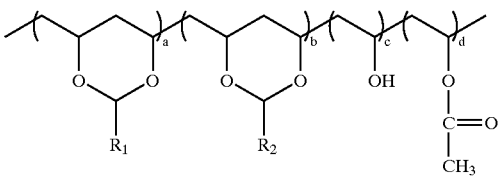

wherein each $R_1$ is an alkyl group of from 0 to 5 carbon atoms, wherein each alkyl group independently can be linear, branched, or cyclic; each $R_2$ is a linear, branched, or cyclic alkyl group of from 4 to 25 carbon atoms, or an aryl group of from 4 to 25 carbon atoms, wherein the aryl group is not unsubstituted phenyl;

a represents a mole % of from 0 to 98;

b represents a mole % of from 1 to 98;

c represents a mole % of from 0 to 12;

d represents a mole % of from 0 to 2; and the sum of a, b, c, and d equals 100, and the copolymer having a glass transition temperature (Tg) of from 40° C. to 55° C.

Examples of suitable polyvinylacetal copolymers include those of formulas II through VII:

II

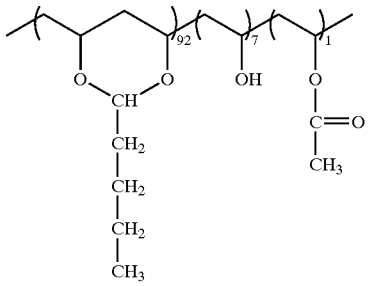

III

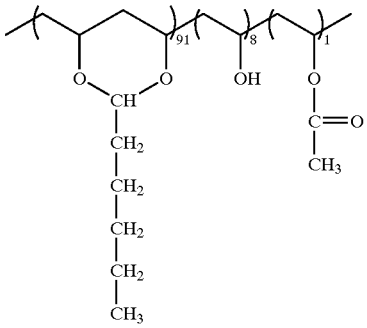

IV

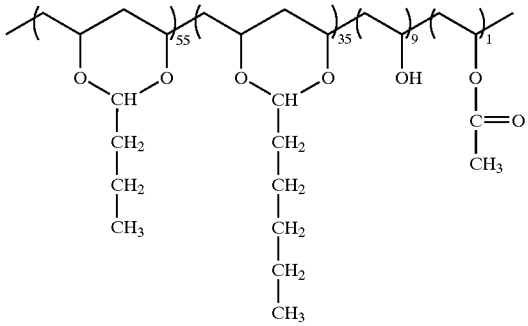

-continued

V

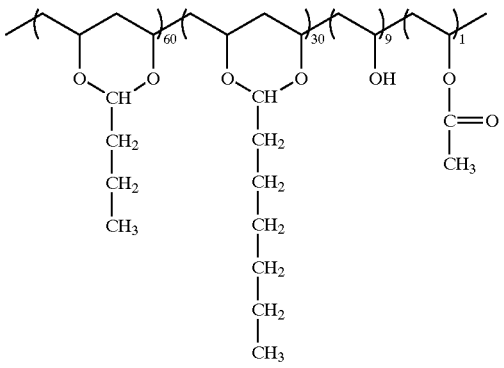

VI

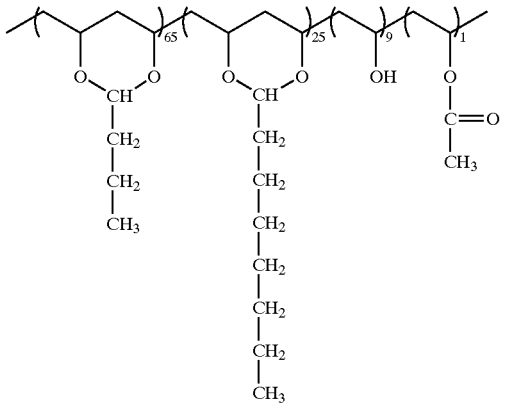

VII

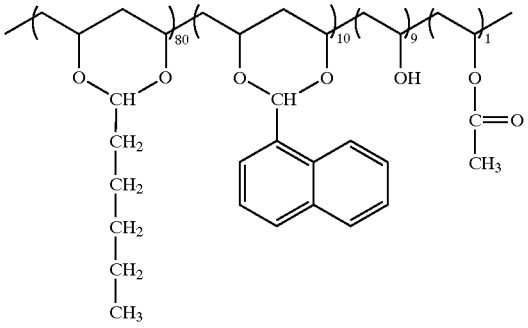

As can be seen from Formulas II–VII, $R_1$ can be, for example, an alkyl group of 3 to 5 carbons; $R_2$ can be an alkyl group of at least 4–7 carbon atoms, or an aryl group such as a fused ring; a can be any mole percent of 0–98, for example, 0, 55, 60, 65, or 80; b can be any mole percent from 1 to 98, for example, 10, 25, 30, 35, 91, or 92; c can be any mole percent from 0 to 12, for example, from 7 to 9; and d can be 0, 1, or 2 mole percent. Examples of suitable polyvinylacetal copolymers can include, but are not limited to, polyvinylpental, polyvinylhexal, poly(vinylbutyral-co-vinylhexal), poly(vinylbutyral-co-vinylheptal), poly(vinylbutyral-co-vinyloctal), and poly(vinylbutyral-co-vinylnaphthal).

The dye-donor layer of the dye-donor element can be formed or coated on a support. The dye-donor layer composition can be dissolved in a solvent for coating purposes. The dye-donor layer can be formed or coated on the support by techniques such as, but not limited to, a gravure process, spin-coating, solvent-coating, extrusion coating, or other methods known to practitioners in the art.

The support can be formed of any material capable of withstanding the heat of thermal printing. According to various embodiments, the support can be dimensionally stable during printing. Suitable materials can include polyesters, for example, poly(ethylene terephthalate) and poly (ethylene naphthalate); polyamides; polycarbonates; glassine paper; condenser paper; cellulose esters, for example, cellulose acetate; fluorine polymers, for example, poly(vinylidene fluoride) and poly(tetrafluoroethylene-co-hexafluoropropylene); polyethers, for example, polyoxymethylene; polyacetals; polystyrenes; polyolefins, for example, polyethylene, polypropylene, and methylpentane polymers; polyimides, for example, polyimide-amides and polyether-imides; and combinations thereof. The support can have a thickness of from 1 $\mu$m to 30 $\mu$m, for example, from 3 $\mu$m to 7 $\mu$m.

According to various embodiments, a subbing layer, for example, an adhesive or tie layer, a dye-barrier layer, or a combination thereof, can be coated between the support and the dye-donor layer. The subbing layer can be one or more layers. The adhesive or tie layer can adhere the dye-donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

The dye-donor element can include a slip layer to reduce or prevent print head sticking to the dye-donor element. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly(caprolactone), carbowax, polyethylene homopolymer, or poly(ethylene glycol). The lubricating material can also be a silicone- or siloxane-containing polymer. Suitable polymers can include graft copolymers, block polymers, copolymers, and polymer blends or mixtures. Suitable polymeric binders for the slip layer can include poly(vinyl alcohol-co-vinylbutyral), poly (vinyl alcohol-co-vinylacetal), polystyrene, poly(vinyl acetate), cellulose acetate butyrate, cellulose acetate, ethyl cellulose, and other binders as known to practitioners in the art. The amount of lubricating material used in the slip layer is dependent, at least in part, upon the type of lubricating material, but can be in the range of from 0.001 to 2 g/m$^2$, although less or more lubricating material can be used as needed. If a polymeric binder is used, the lubricating material can be present in a range of 0.1 to 50 weight %, preferably 0.5 to 40 weight %, of the polymeric binder.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer, or transferring from the slip layer to the dye-donor layer. For example, the stick preventative agent can be present in one or more patches of the dye-donor layer, in the support, in an adhesive layer, in a dye-barrier layer, in a slip layer, or in a combination thereof. According to various embodiments, the stick preventative agent can be in the slip layer, the dye-donor layer, or both. According to various embodiments, the stick preventative agent is in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent. The stick preventative agent can be a silicone- or siloxane-containing polymer. Suitable polymers can include graft copolymers, block polymers, copolymers, and polymer blends or mixtures. Suitable stick preventative agents are described, for example, in commonly assigned U.S. application Ser. Nos. 10/667,065 to David G. Foster, et al., and 10/729,567 to Teh-Ming Kung, et al.

Optionally, release agents as known to practitioners in the art can also be added to the dye-donor element, for example, to the dye-donor layer, the slip layer, or both. Suitable release agents can include, for example, those described in U.S. Pat. Nos. 4,740,496 and 5,763,358.

According to various embodiments, the dye-donor layer can contain no plasticizer. Inclusion of the plasticizer in the dye-donor layer can increase dye-donor efficiency. The dye-donor element can include plasticizers known in the art, such as those described in U.S. Pat. Nos. 5,830,824 and 5,750,465, and references disclosed therein. Suitable plasticizers can be defined as compounds having a glass transition temperature (Tg) less than 25° C., a melting point (Tm) less than 25° C., or both. Plasticizers useful for this invention can include low molecular weight plasticizers and higher molecular weight plasticizers such as oligomeric or polymeric plasticizers. Examples of suitable plasticizers can include aliphatic polyesters, epoxidized oils, chlorinated hydrocarbons, poly(ethylene glycols), poly(propylene glycols), and poly(vinyl ethyl ether) (PVEE). The molecular weight of the plasticizer can be greater than or equal to 450 to minimize transfer of the plasticizer to the dye-receiving layer during printing. Transfer of some plasticizers to the dye-receiving layer can result in image keeping and stability problems. Also, some low molecular weight plasticizers can cause raw stock keeping problems in the dye donor layer. The plasticizer can be present in an amount of from 1 to 50%, for example, from 5% to 35%, by weight of the binder.

Aliphatic polyesters suitable as plasticizers can be derived from succinic acid, glutaric acid, adipic acid, pimelic acid, suberic acid, azelaic acid and sebacic acid. The aliphatic polyesters can have one or more functional end groups, for example a carboxyl, hydroxyl, or alkoxyl group, where each alkoxyl group can be from 1 to 18 carbon atoms. Examples of suitable aliphatic polyesters can include Drapex plasticizers (Crompton/Witco Corporation, Middlebury, Conn., USA), such as Drapex 429, and Admex plasticizers (Velsicol Chemical Corporation, Rosemont, Ill., USA) such as Admex 429, and Paraplex G25, Plasthall HA7A, Plasthall P650, Plasthall P-7092, all from CP Hall Company, Chicago, Ill., USA.

Epoxidized oils suitable as plasticizers can include partially or completely epoxidized natural oils, and partially or completely epoxidized derivatized natural oils such as epoxidized soybean oil sold as Paraplex G-60, Paraplex G-62, and Plasthall ESO; epoxidized linseed oil sold as Plasthall ELO; or epoxidized octyl tallate sold as Plasthall S-73, all from C. P. Hall Company.

Chlorinated hydrocarbons suitable for use as plasticizers can include long-chain hydrocarbons or paraffins consisting of methylene, methyl, methane or alkene groups, all of which can have a chlorine substitution. The length of the long-chain hydrocarbon can be between 8 and 30 carbon atoms, for example, between 12 and 24 carbon atoms. The chains can be branched. The amount of chlorine in the paraffin can be between 25 and 75 wt %, for example, between 40 and 70 wt %. Mixtures of chlorinated paraffins can also be used. According to certain embodiments, the chlorinated paraffins can have the formula $C_xH_yC_z$ wherein x is between 11 and 24, y is between 14 and 43, and z is between 3 and 10. Examples of suitable chlorinated hydrocarbons can include Chlorowax liquids sold by Occidental Chemical Corp., Dallas, Tex., USA, and Paroil paraffins sold by Dover Chemical Corp., Dover, Ohio, USA, such as Chlorowax 40 and Paroil 170HV.

Poly(ethylene glycols) and poly(propylene glycols) suitable for use as plasticizers can have unsubstituted end groups (OH), or they can be substituted with one or more functional groups such as an alkoxyl group or fatty acid, where each alkoxyl group or fatty acid can be from 1 to 18 carbon atoms. Examples of suitable poly(ethylene glycols) and poly(propylene glycols) can include TegMer 809 poly (ethylene glycol) from C. P. Hall Co., and PPG #483 poly(propylene glycol) from Scientific Polymer Products, Ontario, N.Y., USA.

The dye-donor layer can include beads. The beads can have a particle size of from 0.5 to 20 microns, preferably from 2.0 to 15 microns. The beads can act as spacer beads under the compression force of a wound up dye-donor roll, improving raw stock keeping of the dye-donor roll by reducing the material transferred from the dye-donor layer to the slipping layer, as measured by the change in sensitometry under accelerated aging conditions, or the appearance of unwanted dye in the laminate layer, or from the backside of the dye-donor element, for example, a slipping layer, to the dye-donor layer. The use of the beads can result in reduced mottle and improved image quality. The beads can be employed in any amount effective for the intended purpose. In general, good results have been obtained at a coverage of from 0.003 to 0.20 g/m$^2$. Beads suitable for the dye-donor layer can also be used in the slip layer.

The beads in the dye-donor layer can be crosslinked, elastomeric beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethylhexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis (oxyethyl) dimethacrylate; 1,4cyclohexylene-bis(oxypropyl) diacrylate; 1,4-cyclohexylene-bis(oxypropyl) dimethacrylate; and ethylene glycol dimethacrylate. The elastomeric beads can have from 1 to 40%, for example, from 5 to 40%, by weight of a crosslinking agent.

The beads in the dye-donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl)

dimethacrylate, 1,4-cyclohexylene-bis(oxypropyl) dimethacrylate, or other crosslinking monomers known to those familiar with the art.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

The receiver element suitable for use with the dye-donor element described herein can be any receiver element as known to practitioners in the art. For example, the receiver element can include a support having thereon a dye image-receiving layer. The support can be a transparent film. Transparent supports include cellulose derivatives, for example, a cellulose ester, cellulose triacetate, cellulose diacetate, cellulose acetate propionate, cellulose acetate butyrate; polyesters, such as poly(ethylene terephthalate), poly(ethylene naphthalate), poly(1,4cyclohexanedimethylene terephthalate), poly(butylene terephthalate), and copolymers thereof; polyimides; polyamides; polycarbonates; polystyrene; poly(vinyl alcohol-co-vinlyacetal); polyolefins, such as polyethylene or polypropylene; polysulfones; polyacrylates; polyetherimides; and mixtures thereof. Opaque supports can include plain paper, coated paper, synthetic paper, photographic paper support, melt-extrusion-coated paper, and laminated paper, such as biaxially oriented support laminates. Biaxially oriented support laminates suitable for use as receivers are described in U.S. Pat. Nos. 5,853,965; 5,866,282; 5,874,205; 5,888,643; 5,888,681; 5,888,683; and 5,888,714. Biaxially oriented supports can include a paper base and a biaxially oriented polyolefin sheet, for example, polypropylene, laminated to one or both sides of the paper base. The support can be a reflective paper, for example, baryta-coated paper, white polyester (polyester with white pigment incorporated therein), an ivory paper, a condenser paper, or a synthetic paper, for example, DuPont Tyvek® by E.I. DuPont de Nemours and Company, Wilmington, Del. The support can be employed at any desired thickness, for example, from 10 $\mu$m to 1000 $\mu$m. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a nonvoided layer, a synthetic paper, a natural paper, and a polymer.

The dye image-receiving layer of the receiver element can be, for example, a polycarbonate, a polyurethane, a polyester, polyvinyl chloride, poly(styrene-co-acrylonitrile), poly (caprolactone), poly(vinyl chloride-co-vinyl acetate), poly (ethylene-co-vinyl acetate), polyvinylacetals such as polyvinylbutyral or polyvinylheptal, polymethacrylates including those described in U.S. Pat. No. 6,361,131, or combinations thereof. The dye image-receiving layer can be coated on the receiver element support in any amount effective for the intended purpose of receiving the dye from the dye-donor layer of the dye-donor element. For example, the dye image-receiving layer can be coated in an amount of from 1 g/m$^2$ to 5 g/m$^2$. Additional polymeric layers can be present between the support and the dye image-receiving layer. The additional layers can provide coloring, adhesion, antistat properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as described for the donor element. According to various embodiments, the receiver element and dye-donor element can include the same stick preventative agent.

The dye image-receiving layer can be formed on the support by any method known to practitioners in the art, including but not limited to printing, solution coating, dip coating, and extrusion coating. Wherein the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element.

The dye-donor element and receiver element, when placed in superimposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise or patch-wise to the dye-donor element, causing the dyes or laminate in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1 A).

Use of the dye-donor element including a polyvinylacetal copolymer binder as described herein allows normal and high-speed printing of the print assembly, wherein high speed printing refers to printing at a line speed of 2.0 msec/line or less, for example, 1.5 msec/line or less, 1.2 msec/line or less, 1.0 msec/line or less, or 0.5 msec/line or less. Use of a polyvinylacetal copolymer as a binder can produce a defect-free image, with reduced or no sticking of the donor and receiver elements during printing.

Examples are herein provided to further illustrate the invention.

EXAMPLES

In the following examples, glass transition temperatures were determined by differential scanning calorimetry. Glass transition temperature (Tg) is determined to be the midpoint in a heat capacity transition while increasing the temperature of a quenched sample at a heating rate of 10° C./min in a nitrogen atmosphere. Copolymer compositions were determined using $^{13}$C-nuclear magnetic resonance spectroscopy ($^{13}$C-nmr) on a 125 MHz Fourier transform Varion nmr spectrometer.

For all examples, a receiver with the composition shown below was used. The receiver had an overall thickness of about 220 μm and a thermal dye receiver layer thickness of about 3 μm. The receiver was prepared by solvent-coating the subbing layer and dye-receiving layer onto a prepared paper support.

| |
|---|
| 4–8 μm divinylbenzene beads and solvent-coated crosslinked polyol |
| dye-receiving layer |
| Subbing layer |
| Microvoided composite film OPPalyte 350 K18 (ExxonMobil) |
| Pigmented polyethylene |
| Cellulose Paper |
| Polyethylene |
| Polypropylene film |

Example 1

Inventive Polymer I-1: Poly(vinylhexal-co-vinyl alcohol-co-vinyl acetate)

A 5-liter, 3-necked round-bottomed flask was fitted with a mechanical stirrer, reflux condenser, and inert gas inlet tube. Absolute ethanol (1421 mL) was added to the flask followed by 120 g of poly(vinyl alcohol) (1.362 mol), obtained as Elvanol 71–30; 99–99.8% hydrolyzed, viscosity 28–32, from DuPont. This mixture was stirred overnight at room temperature. The stirred mixture was heated in a water bath at 75° C., and 1.63 mL of concentrated sulfuric acid was added to the flask with stirring. A solution of 147.2 mL of hexaldehyde (1.226 mol; 0.90 equivalents) in 1379 mL of dioxane was added to the reaction mixture with stirring over 50 minutes. The mixture was stirred at 75° C. for 18 hours, and then cooled to room temperature. The resultant polymer solution was clear and slightly yellow. It was precipitated into 7×3500 mL of water in a blender, and filtered. The collected white precipitate was washed well with fresh water. The polymer precipitate was stirred in a pH 10 aqueous NaOH solution for several hours, filtered, washed until the filtrate was neutral, and dried in vacuo. The polymer was then dissolved in tetrahydrofuran to make a 15 wt. % solution, reprecipitated in a large excess of water, washed, and dried. The glass transition temperature of the resultant polymer was 46.5° C. The composition of the polymer was determined by $^{3}$C-nmr to be a copolymer of 91 wt % vinylhexal, 8 wt % vinyl alcohol, and 1 wt % vinyl acetate.

Inventive Polymer I-2: Poly(vinylhexal-co-vinylbutyral-co-vinyl alcohol-co-vinyl acetate) (60/40 mol. %)

This copolymer was prepared the same as Inventive Polymer I-1, except that instead of pure hexaldehyde, 98.1 mL of hexaldehyde (0.817 mol; 0.60 equivalents) and 49.1 mL of butyraldehyde (0.545 mol; 0.40 equivalents) were added to the poly(vinyl alcohol). The glass transition temperature of the resulting copolymer was 51.3° C. The composition of the copolymer was determined by $^{13}$C-nmr to be 57 wt % vinylhexal, 37 wt % vinylbutyral, 6 wt % vinyl alcohol, and less than 1 wt % vinyl acetate.

Comparative Polymer C-1: Poly(vinylhexal-co-vinyl alcohol-co-vinyl acetate)

This copolymer was prepared in the same manner as Inventive Polymer I-1, except that 200 mL of hexaldehyde (1.666 mol; 1.23 equivalents) was added to the poly(vinyl alcohol). The glass transition temperature was 38.5° C. The composition of the copolymer was determined by $^{13}$C-nmr to be 96 wt % vinylhexal, 4 wt % vinyl alcohol, and less than 1 wt % vinyl acetate.

Inventive Example I-1

A dye-donor element was prepared by coating the following layers in the order recited on a first side of a 4.5 micron poly(ethylene terephthalate) support:

(1) a subbing layer of a titanium alkoxide (Tyzor TBT® from E.I DuPont de Nemours and Company) (0.16 g/m$^2$) from an n-propyl acetate and n-butyl alcohol solvent mixture, and (2) a dye-donor layer containing the cyan dyes illustrated below in the following amounts: cyan dye #1 at 0.092 g/m$^2$, cyan dye #2 at 0.084 g/m$^2$, and cyan dye #3 at 0.210 g/m$^2$; Inventive polymer I-1 at 0.225 g/m$^2$; 0.017 g/m$^2$ Paraplex G25 (CP Hall Co.); and divinylbenzene beads at 0.008 g/m$^2$ coated from a solvent mixture of 75 wt. % toluene, 20 wt. % methanol, and 5 wt. % cyclopentanone.

cyan dye #1

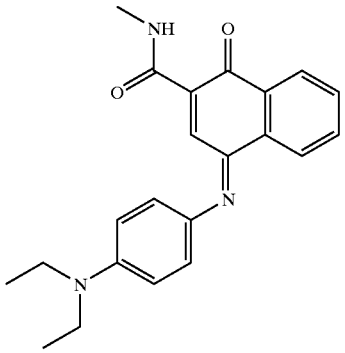

cyan dye #2

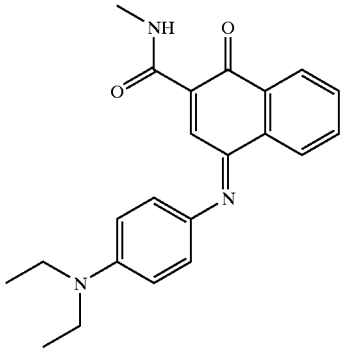

-continued cyan dye #3

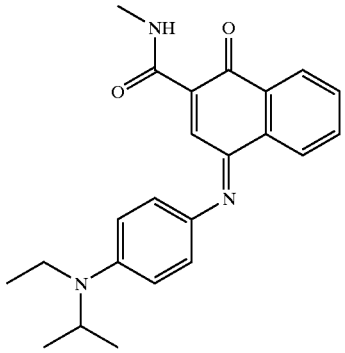

On a second side of the support, a slipping layer was prepared by coating the following layers in the order recited:

(1) a subbing layer of a titanium alkoxide (Tyzor TBT®) (0.16 g/m$^2$) from n-propyl acetate and n-butyl alcohol solvent mixture, and (2) a slipping layer containing an ethene polymer of Polywax 400® (Baker-Petrolite Polymers, Sugar Land, Tex.) (0.02 g/m$^2$), a poly(alpha-olefin) Vybar 103® (Baker-Petrolite Polymers) (0.02 g/m$^2$), and a maleic anhydride copolymer Ceremer 1608 (Baker-Petrolite Polymers) (0.02 g/m$^2$), and a polyvinylacetal binder (0.41 g/m$^2$) (Sekisui KS-1) coated from a solvent mixture of 75 wt. % toluene, 20 wt. % methanol, and 5 wt. % cyclopentanone.

Comparative Example C-1

Comparative dye-donor element C-1 was prepared the same as Inventive Example I-1, except that Comparative Polymer C-1 (0.225 g/m2) was used instead of Inventive Polymer I-1.

Comparative Example C-2

Comparative dye-donor element C-2 was prepared the same as Comparative Example C-1, except that Butvar B-76 (Monsanto Co.) (0.225 g/m2) was used instead of Comparative Polymer C-1.

An 11-step patch image of optical density (OD) ranging from $D_{min}$ (OD<0.2) to $D_{max}$ was printed for donor-receiver sensitometry and sticking performance evaluation. When printed at a speed of 0.52 msec/line and a resistive head voltage of 25 V, this is equivalent to equal energy increments ranging from a print energy of 0 Joules/cm$^2$ to a print energy of 0.633 Joules/cm2. Printing was done manually as described below.

The dye side of the dye-donor element was placed in contact with the dye image-receiving layer of the receiver element of the same width to form a print assembly. The print assembly was fastened to a stepper motor driven pulling device. The imaging electronics were activated, causing the pulling device to draw the print assembly between the print head and a roller at a rate of about 163 mm/sec. The printing line time was 0.52 msec/line. The voltage supplied to the resistive print head was constant for a given print.

After each print, the dye-donor element and receiver element were separated manually, and the Status A red reflection density of each printed step of the 11-step patch image on the receiver was measured using an X-Rite Transmission/Reflection Densitometer (model 820; X-Rite Incorporated). The values of the red density obtained and the sticking performance of each donor-receiver assembly are reported in Table 1.

TABLE 1

| | Binder | Tg (° C.) | Density at 0.633 J/cm$^2$ | Sticking |
|---|---|---|---|---|
| I-1 | Polymer I-1 | 46.5 | 0.89 | no |
| C-1 | Polymer C-1 | 38.5 | 1.0 | yes |
| C-2 | Butvar B76 | 67.0 | 0.81 | no |

The above results show that a polyvinylacetal copolymer of the invention provides a higher optical density than a polyvinylacetal copolymer with a higher glass transition temperature (C-2). The results also show that a polyvinylacetal copolymer having a low glass transition temperature results in sticking.

Example 2

Inventive Example I-2

This dye-donor element was prepared the same as Inventive Example I-1, except that a stick preventative agent, Silwet L-7230 (Crompton Corporation, Long Reach, West Va.) was added in an amount of 0.001 g/m$^2$.

Inventive Example I-3

This dye-donor element was prepared the same as Inventive Example I-2, except that Inventive Polymer I-2 (0.225 g/m2) was used instead of Inventive Polymer I-1.

Comparative Example C-3

This dye-donor element was prepared the same as Inventive example I-2, except that Butvar B-76 (Monsanto Co.) (0.225 g/m2) was used instead of Inventive Polymer I-2.

Printing was carried out on the receiver as described in Example 1, except that a resistive head voltage of 26 V was used, equivalent to equal energy increments ranging from a print energy of 0 Joules/cm$^2$ to a print energy of 0.684 Joules/cm$^2$. The values of the red density obtained and the sticking performance of each donor-receiver assembly are reported in Table 2.

TABLE 2

| | Binder | Tg (° C.) | Density at 0.684 J/cm$^2$ | Sticking |
|---|---|---|---|---|
| I-2 | Polymer I-1 | 46.5 | 0.99 | no |
| I-3 | Polymer I-2 | 51 | 0.99 | no |
| C-3 | Butvar B76 | 67 | 0.91 | no |

The above results show that when a polyvinylacetal copolymer of the invention is used as the binder in a dye-donor layer, higher optical densities can be obtained.

As described and exemplified herein, all polyvinylacetal copolymers do not perform equally at fast printing speeds because they do not transfer sufficient amounts of dye from the donor to the receiver element to achieve high image densities. The dye transfer efficiency from the donor to the receiver is much increased when a polyvinylacetal copolymer as described in the invention is the dye-donor layer binder. Use of a polyvinylacetal copolymer as described in the invention as a binder reduces or eliminates donor-receiver sticking, increases print density, enables fast printing while maintaining or increasing print density, or a combination thereof.

The invention has been described in detail with particular reference to certain preferred embodiments thereof, but it will be understood that variations and modifications can be effected within the spirit and scope of the invention.

What is claimed is:

1. A thermal dye donor element comprising a support and a dye layer, wherein the dye layer comprises a dye and a binder of the following formula:

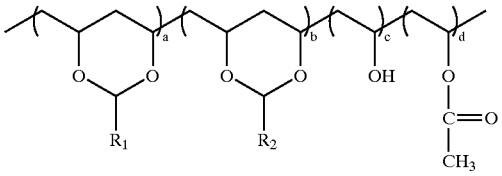

wherein each $R_1$ is an alkyl group of from 0 to 5 carbon atoms, wherein each alkyl group independently can be linear, branched, or cyclic; each $R_2$ is a linear, branched, or cyclic alkyl group of from 4 to 25 carbon atoms, or an aryl group of from 4 to 25 carbon atoms, wherein the aryl group is not unsubstituted phenyl;

a represents a mole % of from 0 to 98;

b represents a mole % of from 1 to 98;

c represents a mole % of from 0 to 12;

d represents a mole % of from 0 to 2; and the sum of a, b, c, and d equals 100, and the copolymer having a glass transition temperature (Tg) of from 40° C. to 55° C.

2. The element of claim 1, wherein c is from 7 to 9.

3. The element of claim 1, wherein R2 is a fused ring.

4. The element of claim 1, wherein $R_1$ is from 3 to 5 carbon atoms.

5. The element of claim 1, wherein R2 is from 4 to 10 carbon atoms.

6. The element of claim 1, wherein d is 1.

7. The element of claim 1, wherein the dye layer does not include a plasticizer.

8. The element of claim 1, wherein the dye layer includes a plasticizer.

9. The dye-donor element of claim 8, wherein the plasticizer is an aliphatic polyester, an epoxidized oil, a chlorinated hydrocarbon, a poly(ethylene glycol), a poly(propylene glycol), a poly(vinyl ethyl ether), or a combination thereof.

10. The dye-donor element of claim 8, wherein the plasticizer is a polyester adipate, a polyester sebacate, poly (propylene glycol), or polyester glutarate.

11. The dye-donor element of claim 8, wherein the plasticizer is present in an amount from 1 wt. % to 35 wt. % of the weight of the binder.

12. A print assembly comprising a donor and a receiver, wherein the donor comprises a support and a dye layer, wherein the dye layer comprises a binder of claim 1 and a dye, and wherein the receiver comprises a support and a dye-receiving layer on the support.

13. The print assembly of claim 12, wherein the dye-receiving layer is extruded.

14. A method of printing, comprising obtaining a donor comprising a support and a dye layer, wherein the dye layer comprises the binder of claim 1 and a dye;

obtaining a receiver having a support and a dye-receiving layer on the support;

placing the dye layer of the donor adjacent the dye-receiving layer of the receiver; and applying heat in an imagewise fashion to the donor to form a dye image on the receiver.

15. The method of claim 14, wherein the image is formed at a line speed of 2 msec or less.

16. The method of claim 14, wherein obtaining the receiver comprises extruding the dye-receiving layer onto the support.

17. The method of claim 14, wherein the dye layer does not include a plasticizer.

18. The method of claim 14, wherein the dye layer includes a plasticizer.

19. The method of claim 18, wherein the plasticizer is an aliphatic polyester, an epoxidized oil, a chlorinated hydrocarbon, a poly(ethylene glycol), a poly(propylene glycol), a poly(vinyl ethyl ether), or a combination thereof.

20. The method of claim 18, wherein the plasticizer is a polyester adipate, a polyester sebacate, poly(propylene glycol), or polyester glutarate.

21. The method of claim 18, wherein the plasticizer is present in an amount from 1 wt. % to 35 wt. % of the weight of the binder.

* * * * *